United States Patent [19]

Ohara et al.

[11] 4,452,209

[45] Jun. 5, 1984

[54] AIR-FUEL RATIO CONTROL SYSTEM FOR AN INTERNAL COMBUSTION ENGINE

[75] Inventors: Yoshiaki Ohara; Hideo Yabuhara, both of Musashino, Japan

[73] Assignees: Fuji Jukogyo Kabushiki Kaisha, Tokyo; Nissan Motor Co., Ltd., Yokohama, both of Japan

[21] Appl. No.: 337,631

[22] Filed: Jan. 7, 1982

[30] Foreign Application Priority Data

Jan. 16, 1981 [JP] Japan ..... 56-5613

[51] Int. Cl.[3] ..... F02B 3/00

[52] U.S. Cl. ..... 123/489; 123/438; 123/440

[58] Field of Search ..... 123/440, 438, 489, 492

[56] References Cited

U.S. PATENT DOCUMENTS

| | | | |
|---|---|---|---|
| 3,973,529 | 8/1976 | Wessel et al. | 123/489 |
| 4,040,394 | 8/1977 | Wahl et al. | 123/440 |
| 4,240,389 | 12/1980 | Shimazaki | 123/440 |
| 4,248,196 | 2/1981 | Toelle | 123/489 |
| 4,265,208 | 5/1981 | Emmert et al. | 123/440 |
| 4,356,797 | 11/1982 | Matsui | 123/440 |
| 4,364,358 | 12/1982 | Shikata et al. | 123/440 |

*Primary Examiner*—Parshotam S. Lall
*Attorney, Agent, or Firm*—Martin A. Farber

[57] ABSTRACT

An air-fuel ratio control system for a vehicle powered by an internal combustion engine having an emission control system with a three-way catalytic converter for controlling the air-fuel ratio in accordance with the operation of the engine. A vacuum sensor detects heavy load operation of the engine, and an engine speed detecting circuit and a predetermined voltage supply circuit are provided. The engine speed detecting circuit is so arranged as to produce an output when the engine speed is lower than a predetermined value. A feedback control circuit is provided for controlling the air-fuel ratio to the stoichiometric air-fuel ratio in normal operating conditions. A first switch device is actuated by the output of the vacuum sensor to connect the output of the predetermined voltage supply circuit with the input of the feedback control circuit when heavy load operation is detected and to render the feedback control circuit inoperative. A second switch is to be actuated by the output of the engine speed detecting circuit to stop the control of the air-fuel ratio for supplying a rich air-fuel mixture by the carburetor to the engine.

8 Claims, 5 Drawing Figures

AIR-FUEL RATIO CONTROL SYSTEM FOR AN INTERNAL COMBUSTION ENGINE

BACKGROUND OF THE INVENTION

The present invention relates to an air-fuel ratio control system for an internal combustion engine mounted on a vehicle, which controls the air-fuel ratio of air-fuel mixture to a value approximately equal to the stoichiometric air-fuel ratio at which a three-way catalyst acts most effectively, and more particularly to an air-fuel ratio control system which is capable of improving the driveability of the vehicle during heavy load operation by holding the air-fuel ratio to a predetermined value.

In a conventional air-fuel ratio control system, the air-fuel ratio of the air-fuel mixture burned in the cylinders of the engine is detected as an oxygen density of the exhaust gases by means of an $O_2$ sensor provided in the exhaust system of the engine. A determination is made by an output signal from the $O_2$ sensor as to whether the air-fuel ratio is richer or leaner than the value corresponding to the stoichiometric air-fuel ratio for producing the control signal. The control signal is converted to pulses which operate an electromagnetic valve for regulating the feed rate of air to be mixed with the mixture. Thus, the air-fuel ratio is controlled to the stoichiometric air-fuel ratio at which three-way catalyst acts most effectively. In such an air-fuel ratio control system, when the throttle valve of the engine is opened wide or fully opened at heavy load, the feedback control operation, which depends on the detected signal by the $O_2$ sensor, is stopped and the control signal is fixed, by an enriching system, to a predetermined value, so that the correction air rate is held to a predetermined value to enrich the air-fuel mixture so as to improve the driveability of the vehicle.

FIG. 5 shows such control ranges. A load detecting curve detected by a load sensor is in a lower position than a wide open throttle WOT curve. In the region below the load detecting curve, the feedback control operation is carried out, and in the region between the load detecting curve and the wide open throttle curve, the feedback control is not operated and the air-fuel ratio is fixed to a predetermined value.

In FIG. 5 reference Y represents an output torque curve relative to the engine speed when the vehicle is rapidly started. In such an operation, the output torque curve has a steep inclination. The output torque decreases in the fixed air-fuel ratio zone because of insufficient air-fuel ratio of the mixture. In order to resolve such a problem, if the air-fuel ratio is fixed to a small value, which means a rich air-fuel mixture, the mixture becomes excessively rich in a high engine speed zone resulting in decrease of the output of the engine.

SUMMARY OF THE INVENTION

Accordingly, the present invention seeks to provide an air-fuel ratio control system in which air-fuel ratio is varied with the engine speed during heavy load operation for the purpose of improving driveability of a vehicle.

According to the present invention, there is provided an air-fuel ratio control system for a vehicle powered by an internal combustion engine having an induction passage, a carburetor, an electromagnetic valve for correcting the air-fuel ratio of the air-fuel mixture supplied to the carburetor, an $O_2$ sensor for detecting the oxygen density in exhaust gases, and a feedback control circuit responsive to the output of the $O_2$ sensor for producing a control output signal for driving the electromagnetic valve for correcting the air-fuel ratio; the improvement comprises: a first detecting means for detecting the operation of the engine and for producing an output signal when load of the engine exceeds a predetermined value; a second detecting means for detecting the engine speed and for producing a signal when the engine speed is lower than a predetermined value; a voltage applying circuit for applying a predetermined voltage to the input of the feedback control circuit; a first switch means responsive to the output signal of the first detecting means to connect the output of the voltage applying circuit with the input of the feedback control circuit and to render the feedback control circuit inoperative as a feedback controller and operative as an amplifier so as to supply a rich air-fuel mixture to said carburetor; and a second switch means responsive to the output signal of the second detecting means for changing the electromagnetic valve so as to supply a still richer air-fuel mixture.

With the above and other objects and advantages in view, the present invention will become more clearly understood in connection with the detailed description of preferred embodiments, when considered with the accompanying drawings, of which:

DETAILED DESCRIPTION OF THE PREFERRED EMBODIMENTS

Figure 1:
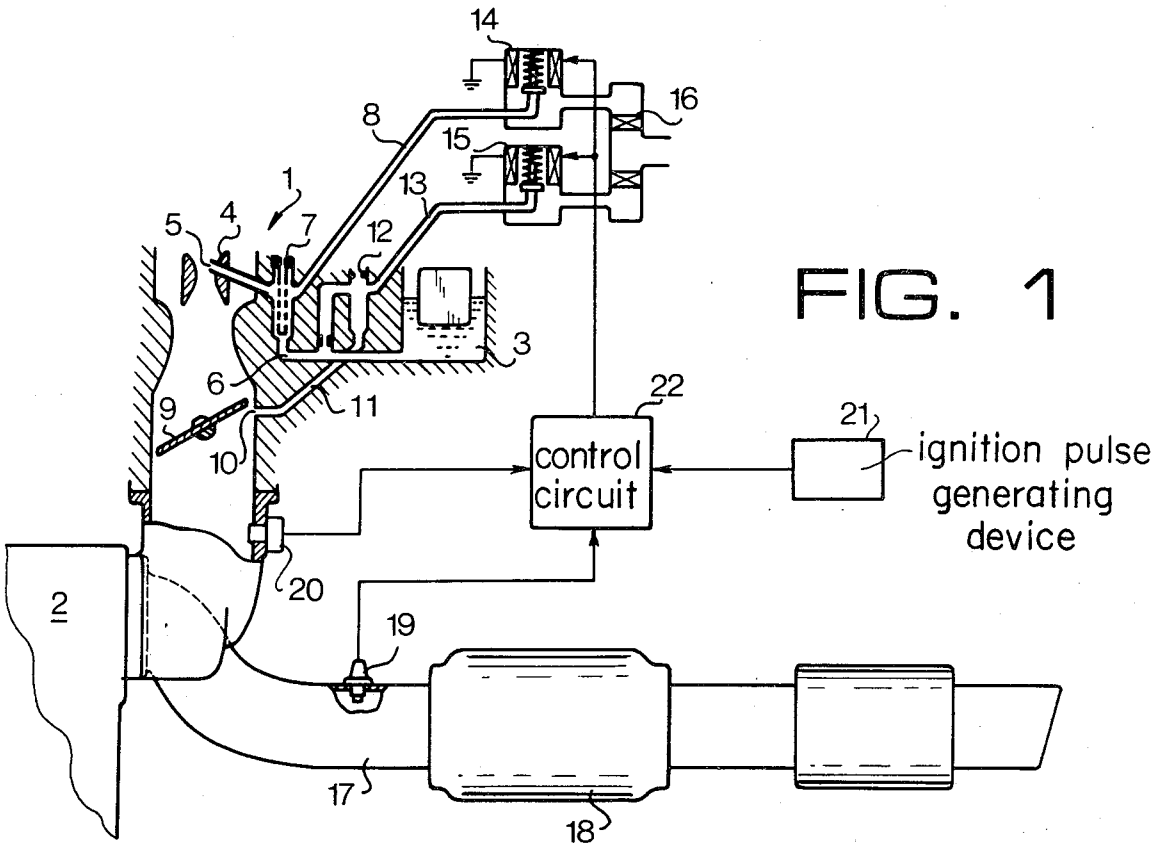
FIG. 1 is a schematic explanatory view of the present air-fuel ratio control system.

Referring to FIG. 1 showing schematically the air-fuel ratio control system, a carburetor 1 is provided upstream of an engine 2. A correcting air passage 8 communicates with an air-bleed 7 which is provided in a main fuel passage 6 between a float chamber 3 and a nozzle 5 in a venturi 4 in the induction air passage. Another correcting air passage 13 communicates with another air-bleed 12 which is provided in a slow fuel passage 11 which diverges from the main fuel passage 6 and extends to a slow port 10 opening into the induction passage the vicinity of a throttle valve 9. These correcting air passages 8 and 13 communicates with on-off type electromagnetic valves 14, 15, induction sides of which communicate with the atmostphere through an air cleaner 16. Further, a three-way catalytic converter 18 is provided in an exhaust pipe 17 downstream of the engine 2, and an $O_2$ sensor 19 is provided between the engine 2 and the converter 18 to detect the oxygen concentration of the exhaust gases which is representative of the air-fuel ratio of the mixture burned in the cylinders of the engine.

A vacuum sensor 20 is provided in the induction air passage downstream of the throttle valve 9 to detect vacuum in the induction air passage, and an ignition pulse generating device 21 is provided to generate pulses in synchronism with the engine ignition. Output signals from these sensors 19, 20, and from the ignition pulse generating device 21 are sent to a control circuit 22 which produces an output signal to actuate the electromagnetic valves 14, 15 to open and close at duty ratios varying according to the output signals of the sensors 19, 20 and the device 21. Thus, a great deal of air is supplied to the fuel system through the air correcting passages 8, 13 to produce a lean air-fuel mixture or a small amount of air is supplied to enrich the air-fuel mixture.

Figure 2:
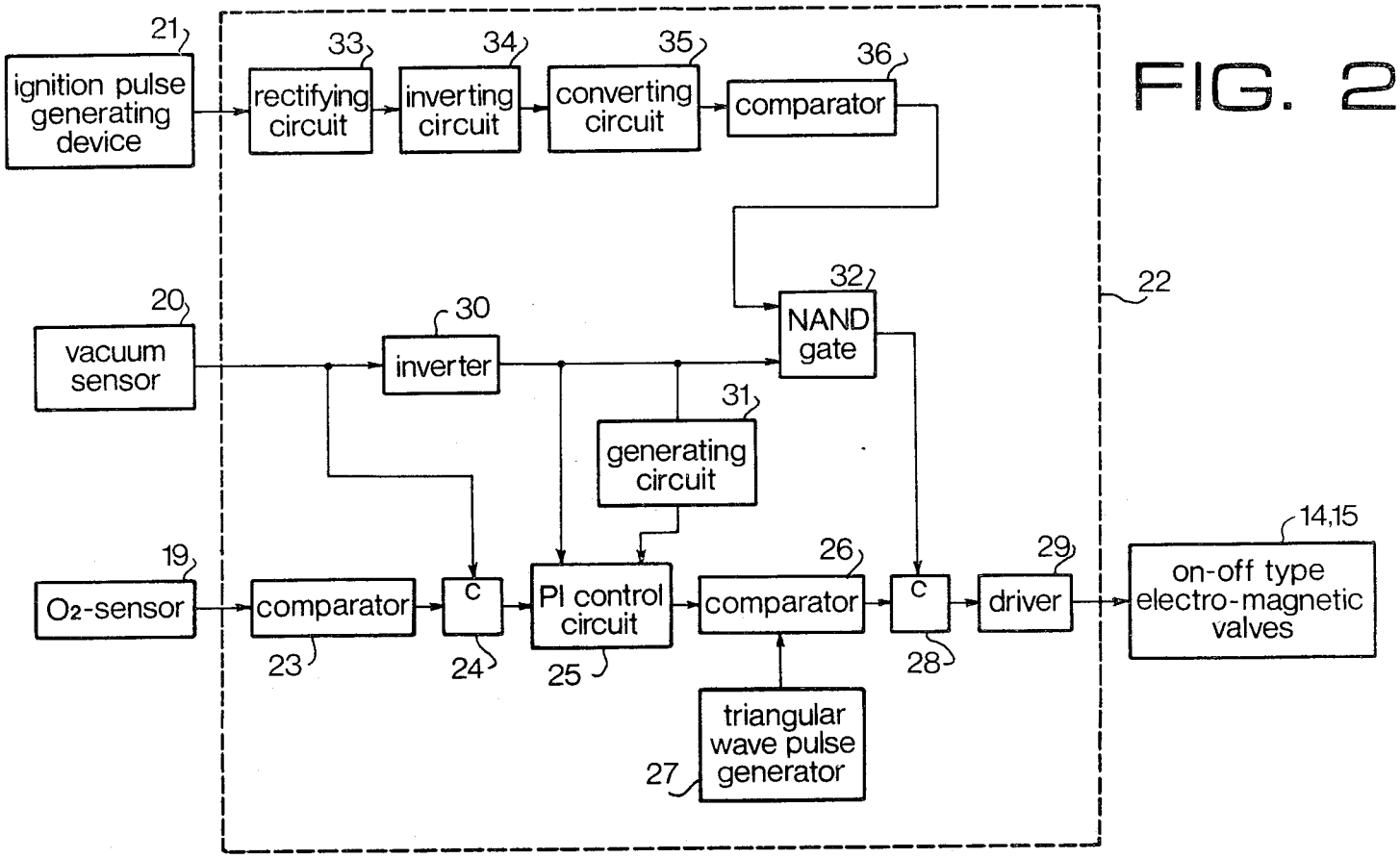
FIG. 2 is a block diagram showing a construction of a control circuit of the present invention.

FIG. 2 shows the construction of the control circuit 22. The output of the $O_2$ sensor 19 is applied to a PI (proportion and integration) control circuit 25 through a comparator 23 and an analogue switch 24. The output of the PI control circuit 25 is applied to another comparator 26. The comparator 26 compares the output of the PI control circuit 25 with triangular wave pulses from a triangular wave pulse generator 27 and produces square wave pulses as a result of the comparison. The square wave pulses are fed to the electromagnetic valves 14, 15 via a driver 29 for operating the valves. The output of the vacuum sensor 20 is sent to a fixed duty ratio signal generating circuit 31 via an inverter 30 and to the analogue switch 24. The output of the inverter 30 is also applied to the PI control circuit 25 and to a NAND gate 32. The output of the NAND gate is applied to an analogue switch 28. The output of the ignition pulse generating device 21 is sent to a rectifying circuit 22, the output of which is applied to a converting circuit 35 via an inverting circuit 34. The output of the converting circuit 35 is applied to the NAND gate 32 via a comparator 36.

Figure 3:
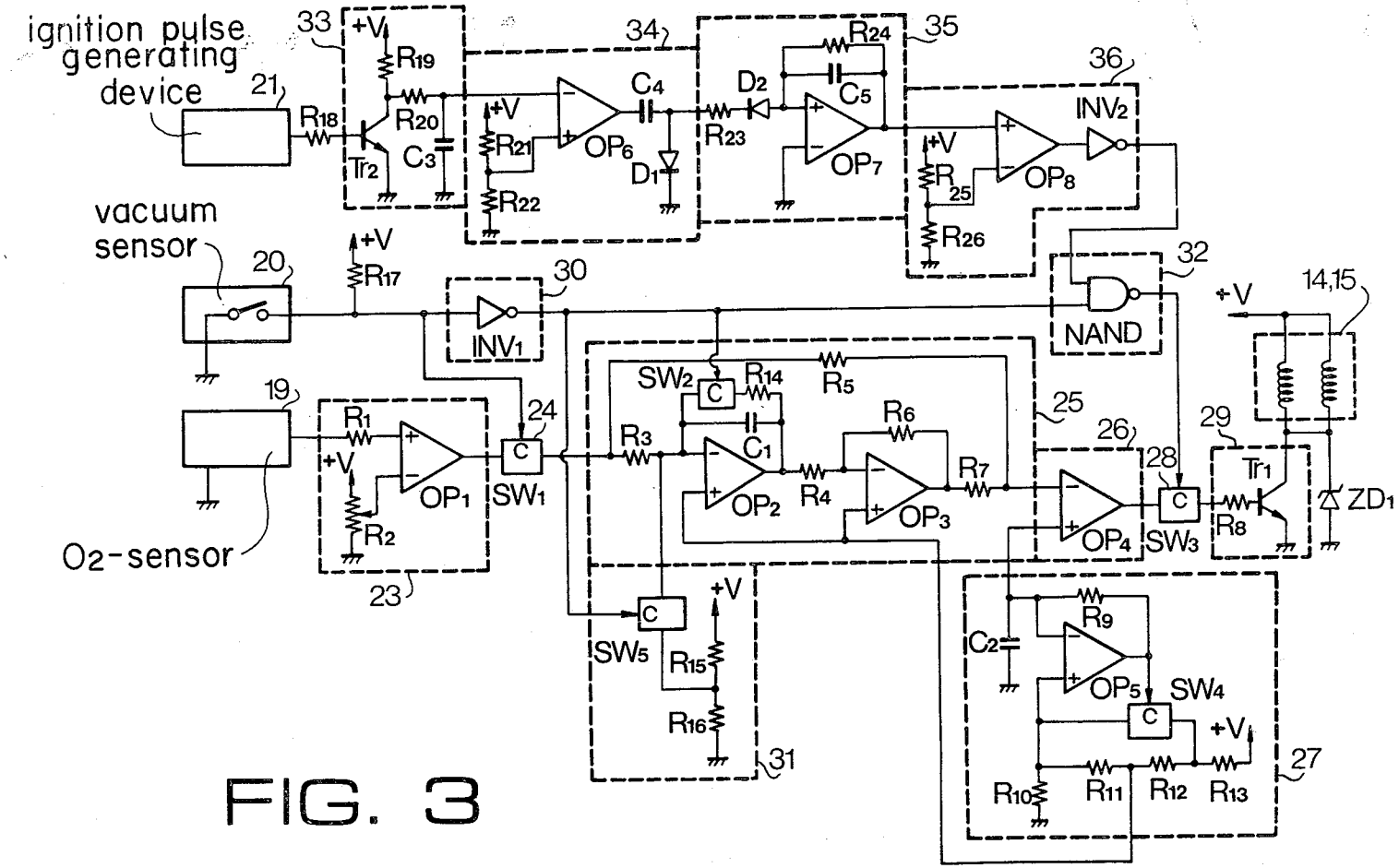
FIG. 3 is an electric circuit of the control circuit shown in FIG. 2.

FIG. 3 is a detailed electric circuit of the control circuit of FIG. 2, in which the same parts are identified by the same numerals as in FIG. 2.

The operation of the preferred embodiment present system will be explained hereinafter.

When the engine is operated in light load conditions

Figure 4:
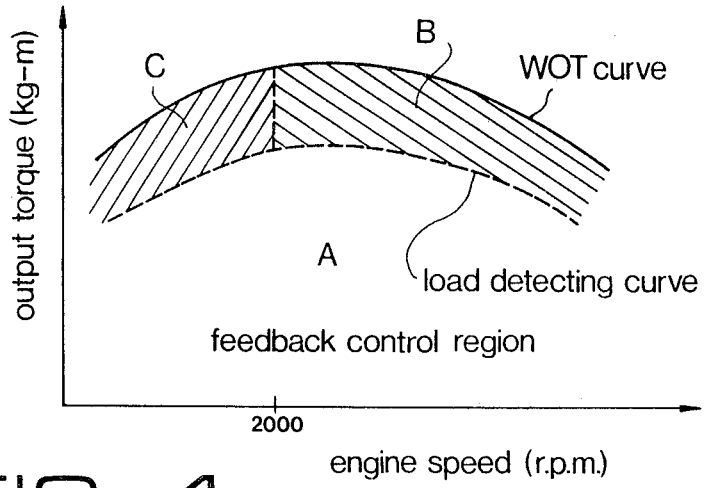
FIG. 4 is a graph showing operation regions of a system in accordance with an embodiment of the present invention.
Figure 5:
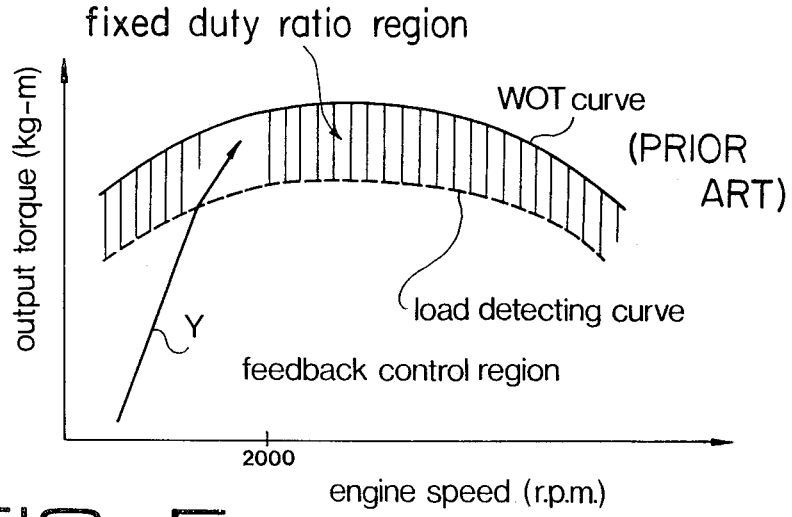
FIG. 5 is a graph showing operation regions of a conventional system.

Referring to FIGS. 2 and 3, since the vacuum in the induction passage of the engine is high under light load conditions, the vacuum switch 20 is turned off to produce a high level output via +V through resistor $R_{17}$ which turns on the analogue switch 24. A low level output of the inverter 30 is applied to the NAND gate 32, so that the output thereof goes to a high level which turns on the analogue switch 28. On the other hand, an operational amplifier $OP_1$ in the comparator 23 compares the output of the $O_2$ sensor 19 corresponding to the air-fuel ratio of the mixture supplied to the engine with a standard voltage representative of the stoichiometric value applied by a voltage divider resistor $R_2$. The output of the comparator 23 is sent to the PI control circuit 25 through the analogue switch 24. The PI control circuit 25 performs an integration operation of the output from the comparator 23, and sends the operating result to the comparator 26. The comparator 26 comprises the output of the control circuit 25 with triangular waves from the triangular wave pulse generator 27 to produce square wave pulses. The square wave pulses turn on and off a transistor $Tr_1$ of the driver 29 so that the electromagnetic valves 14, 15 are driven. In this manner a feedback control operation is continuously performed which converges the air-fuel ratio of the mixture to be supplied to the stoichiometric value. The feedback control operation is carried out in the region A of FIG. 4.

When the engine is operated in heavy load conditions at a high speed

Since the throttle valve 9 is widely or almost fully opened for bearing heavy load, the vacuum in the induction passage decreases. Accordingly, the the vacuum switch 20 is turned on, closing to produce a low level output which causes the analogue switch 24 to turn off, disconnecting the $O_2$ sensor of the feedback control circuit from the electromagnetic valves 14, 15. A high level output of the inverter 30 is applied to the NAND gate 32 and to the analogue switches $SW_2$, $SW_5$ turning on these switches. The switch $SW_5$ now connects the fixed duty ratio signal generating circuit 31 to the control circuit 25, the switch $SW_1$ renders the feedback control circuit inoperative as a feedback controller, and the switch $SW_2$ makes same operative as an amplifier.

On the other hand, ignition pulses from the generator 21 are applied to a transistor $Tr_2$ turning it on and off to produce on-off pulses. The on-off pulses are shaped by the inverting circuit 34 and converted to a direct current by the converting circuit 35. The output of the converting circuit 35 is applied to a comparator $OP_8$ where it is compared to the inverting input voltage divided by resistors $R_{25}$, $R_{26}$. When the engine speed is higher then a predetermined speed, for example 2000 r.p.m., the comparator $OP_8$ produces a high level output. The high level output is inverted to a low level by an inverter $INV_2$ and applied to the NAND gate 32.

Since one of inputs of the NAND gate 32 is at a low level, the output of the NAND gate 32 is at a high level which closes the analogue switch 28. Since the analogue switch 24 is off (open circuited), the feedback operation is not carried out. Since the analogue switch $SW_2$ is on, the PI control circuit 25 stops acting as an integrator and acts as an amplifier applied with the fixed input determined by the resistors $R_{15}$, $R_{16}$ set to represent a rich air-fuel ratio signal from the fixed duty ratio signal generating circuit 31. Thus, the square wave pulse train produced from the comparator 26 has a fixed duty ratio and a rich air-fuel mixture is supplied to the engine for improving the driveability of the vehicle during heavy load operation. The operation is carried out in the region B of FIG. 4.

When the engine is operated in heavy load conditions at a speed lower than a predetermined speed When the engine speed is lower than the predetermined speed (e.g. 2000 r.p.m.), the output of the comparator 36 is at a high level. Since vacuum in the induction passage is low, the vacuum switch 20 is on. Thus, a high level voltage is applied to the NAND gate 32, so that the output of the NAND gate goes to a low level. Accordingly, the analogue switch 28 is turned off and the electromagnetic valves 14, 15 are not driven. Thus, the carburetor 1 supplies a still richer air-fuel mixture to the engine for improving the driveability thereof. Such an operation is carried out in a region C of FIG. 4.

From the foregoing, it will be understood that in heavy load conditions, the feedback control system stops operating as a feedback control system and produces a control signal of a predetermined value to provide a fixed air-fuel ratio. When the engine is operated in the heavy load condition at a low engine speed, the air-fuel mixture is enriched at its highest amount for improving the driveability of the engine.

What is claimed is:

1. In an air-fuel ratio control system for a vehicle powered by an internal combustion engine having an induction passage, a carburetor communicating with said induction passage, and a feedback control circuit including an electromagnetic valve means for correcting the air-fuel ratio of an air-fuel mixture supplied to said carburetor, an $O_2$ sensor for detecting oxygen density in exhaust gases from the engine, and a control circuit responsive to the output of said $O_2$ sensor for producing a control signal for driving said electromagnetic valve means for correcting the air-fuel ratio to a stoichiometric value when the load condition of the engine is below a predetermined heavy load value; the improvement comprising:

first detecting means for detecting the load condition of the engine;

second detecting means for detecting the engine speed; and logic circuit switch means for operatively disconnecting said feedback control circuit when the load condition of the engine exceeds said predetermined heavy load value and in this load condition for operatively supplying to said electromagnetic valve means at least two rich signals, respectively, depending on the respective engine speed, said at least two rich signals being representative of two rich air-fuel ratios, respectively, one of said rich signals being representative of an air-fuel ratio which is richer than the air-fuel ratio of the other of said two rich signals being supplied to said electromagnetic valve means when said engine speed is less than a predetermined engine speed in said above-mentioned load condition.

2. In an air-fuel ratio control system for a vehicle powered by an internal combustion engine having an induction passage, a carburetor operatively communicating with the induction passage, an electromagnetic valve for correcting the air-fuel ratio of the air-fuel mixture supplied to said carburetor, an $O_2$ sensor for detecting oxygen density in exhaust gases from the engine, and a feedback control circuit responsive to the output of said $O_2$ sensor acting as a feedback controller for producing a control signal for driving said electromagnetic valve for correcting the air-fuel ratio to a stoichiometric value when the load of the engine is less than a predetermined heavy load; the improvement comprising:

first detecting means for detecting the operation of said engine and for producing an output signal when the load of the engine exceeds the predetermined heavy load;

second detecting means for detecting the engine speed and for producing an output signal when the engine speed is lower than a predetermined high value;

a fixed voltage applying means for selectively applying a predetermined voltage to said feedback controller circuit, said predetermined voltage representing a rich air-fuel ratio signal;

first switch means and second switch means for being operatively controlled by said first and second detecting means;

said first switch means being responsive to said output signal of said first detecting means for connecting said fixed voltage applying means with said feedback control circuit so as to apply said predetermined voltage thereto and for rendering said feedback control circuit inoperative as the feedback controller responsive to said $O_2$ sensor and operative as an amplifier of said predetermined voltage so as to supply a rich air-fuel mixture to said carburetor when said second switch means is controlled by an absence of said output signal of said second detecting means; and said second switch means being responsive to said output signals of said first and second detecting means for causing said electromagnetic valve to supply an air-fuel mixture which is richer than said rich air-fuel mixture to said carburetor.

3. The air-fuel ratio control system for a vehicle powered by an internal combustion engine in accordance with claim 2 wherein said second switch means operates to stop the operation of said electromagnetic valve for enrichment of the air-fuel mixture when said load of the engine exceeds the predetermined heavy load when the engine speed is lower than the predetermined high value.

4. The air-fuel ratio control system for a vehicle powered by an internal combustion engine in accordance with claim 2 wherein said first detecting means is a vacuum sensor operative by vacuum in said induction passage.

5. The air-fuel ratio control system for a vehicle powered by an internal combustion engine in accordance with claim 2, wherein said feedback control circuit includes an integrator, said first switch means comprises a first switch operatively connected in series between said $O_2$ sensor and said feedback control circuit, a second switch connected in a branch in series with a resistor, said branch being connected in parallel with said integrator, and a third switch connected in series between said fixed voltage applying means and said feedback control circuit, said switch having control gates operatively connected to said first detecting means.

6. The air-fuel ratio control system for a vehicle powered by an internal combustion engine in accordance with claim 2 wherein said second switch means comprises a switch operatively connected in series between said feedback control circuit and said electromagnetic valve, and a logic gate having an output controlling said switch and having inputs operatively connected to said first and second detecting means.

7. The air-fuel ratio control system for a vehicle powered by an internal combustion engine in accordance with claim 6 wherein said logic gate is a NAND gate and an invertor is connected between one of the inputs of said NAND gate and said first detecting means, the latter comprising a vacuum sensor switch operatively communicating with the induction passage, and said second detecting means includes an engine ignition pulse generating device.

8. The air-fuel ratio control system for a vehicle powered by an internal combustion engine in accordance with claim 7 wherein said second detecting means further comprises, means for producing rectified pulses from said engine ignition pulse generating device, a converting circuit means for converting the rectified pulses into a direct current, and a comparator means for comparing said direct current with a predetermined input voltage, said comparator means being connected to the other input of said NAND gate.

* * * * *